US011871886B2

(12) United States Patent
Lloyd

(10) Patent No.: US 11,871,886 B2
(45) Date of Patent: Jan. 16, 2024

(54) ROLLER MOP ASSEMBLY

(71) Applicant: Lisa Lloyd, Phoenix, AZ (US)

(72) Inventor: Lisa Lloyd, Phoenix, AZ (US)

( * ) Notice: Subject to any disclaimer, the term of this patent is extended or adjusted under 35 U.S.C. 154(b) by 221 days.

(21) Appl. No.: 17/149,838

(22) Filed: Jan. 15, 2021

(65) Prior Publication Data

US 2021/0212546 A1 Jul. 15, 2021

Related U.S. Application Data

(60) Provisional application No. 62/961,329, filed on Jan. 15, 2020.

(51) Int. Cl.
*A47L 13/42* (2006.01)
*A47L 13/16* (2006.01)
*A47L 13/20* (2006.01)

(52) U.S. Cl.
CPC ..... *A47L 13/42* (2013.01); *A47L 13/16* (2013.01); *A47L 13/20* (2013.01)

(58) Field of Classification Search
CPC ..... A47L 13/42
See application file for complete search history.

(56) References Cited

U.S. PATENT DOCUMENTS 533,413 A * 1/1895 Name not available ..... A47L 11/4069 15/52
901,978 A * 10/1908 Mally ..... A47L 11/4069 15/52
3,457,575 A * 7/1969 Gunter ..... A47L 11/4069 15/388
3,950,809 A * 4/1976 Schatzmann ..... E04H 4/1654 15/384
4,007,508 A * 2/1977 Ooyachi ..... A47L 11/33 15/42
4,357,727 A * 11/1982 McDowell ..... A47L 11/4013 15/41.1
4,366,593 A * 1/1983 Parikh ..... A47L 11/22 15/49.1
5,735,959 A * 4/1998 Kubo ..... A47L 11/4011 118/712
6,324,714 B1 * 12/2001 Walz ..... A46B 13/001 15/52.1
7,578,020 B2 * 8/2009 Jaworski ..... A47L 11/4047 15/98
8,555,449 B2 * 10/2013 Garcia ..... A47L 11/4047 15/98
2006/0195991 A1 * 9/2006 Baumhakel ..... A47L 11/4077 15/384
2007/0107149 A1 * 5/2007 Kaleta ..... A47L 11/32 15/42

(Continued)

*Primary Examiner* — Eric J Rosen
*Assistant Examiner* — Christopher Soto

(57) ABSTRACT

A floor cleaning apparatus comprises a handle having a proximal end and a distal end; a housing at the distal end of the handle; a plurality of wheels at a bottom of the housing that rotate relative to the housing when a force is applied to the handle; a plurality of interchangeable and removable surface-cleaning rollers at the housing that rotate relative to the housing and the wheels, and that rotate at a different rate of rotation than the wheels; and a gear assembly that communicates with the wheels to rotate adjacent surface-cleaning rollers in different directions relative to each other to mimic a scrubbing motion.

4 Claims, 8 Drawing Sheets

(56) References Cited

U.S. PATENT DOCUMENTS

2017/0234214 A1* 8/2017 Laimboeck ..... F02B 75/20
123/59.6

* cited by examiner

ROLLER MOP ASSEMBLY

RELATED APPLICATIONS

This application claims priority to U.S. provisional application No. 62/961,329, filed Jan. 15, 2020 entitled "MANUAL ROLLER MOP ASSEMBLY," the entirety of which is incorporated by reference herein.

FIELD OF THE INVENTION

The invention relates generally to cleaning apparatuses, and more specifically, to mops, brooms, or the like that clean floor surfaces

BACKGROUND

Currently, there are a number of solutions for cleaning floor surfaces. Some of these solutions attempt to wipe away soft matter and debris as well as scrub caked-on matter. Other solutions, for example, the Swiffer Duster, are used specifically for light cleaning and dusting with removable wipes. However, these solutions fail to meet the needs of the industry because this manual action requires strength and energy making it more difficult for aging, disabled, and weak users and takes the additional time necessary to repeatedly go over caked-on and heavily soiled surfaces to remove. Additionally, conventional mops or related apparatuses require users to rinse the dirty water collected and clean the mop when finished in preparation for reuse. Other solutions attempt to use electric-powered devices to make it easier for users to scrub the surface. However, users are limited by the length of the cord and requires electrical outlets. Still, other solutions seek to solve the power cord problem with batteries. Cordless electrical devices are limited by the amount of time the charge will last and require recharging.

SUMMARY

The present invention relates to a manually operated cleaning apparatus with interchangeable rollers, which requires no batteries or electrical power but nevertheless enables the user to easily clean most hard floor surfaces at an accelerated rate depending on the selected rollers. The core components of the invention are a handle, e.g., a standard adult height handle, attached to a rigid housing that encompasses a combination of rollers, pulleys, gears, and belts of a system for driving one or more removable and interchangeable rollers. This system including the rollers is engaged in response to a user pushing or pulling the mop broom so that the rollers are manipulated to spin by the gears and rollers at an accelerated rate when pushed forward or pulled back, for example, which replicate or mimic a manual surface scrubbing motion, for example, user's back-and-forth motion when cleaning a surface.

In one aspect, an apparatus comprises a manually operated roller mop, which may include but not be limited to the following components (1) a handle such that a user can comfortably stand and direct the floor housing, (2) a housing consisting of four sides and a top for enclosing a system comprising plurality of interconnected gears, belts, and rollers, (3) wheels for rolling the housing and spinning the gears, (4) a set of gears that spin at a higher rate than the wheels, and (5) surface cleaning roller types that are spun by the gears. In some embodiments, there are multiple gears, for example, 3 or more gears, that are attached to the wheels that are larger than they are attached, either directly or by a gear belt to smaller gears to make the rollers spin faster.

In some embodiment, the roller mop comprises an adjustable handle extension such that a user can comfortably stand and direct the floor housing (2) a dense and water-resistant material housing comprising one or more sidewalls and a top enclosure with the bottom open for the gears and rollers to be exposed and easily accessed (3) a set of wheels, e.g., four wheels, attached to the housing for moving along the floor surface and engaging the gears (4) a pulley and/or gear system that is activated by the wheels at a higher turn ratio than the wheels and (5) rollers that are activated to spin at an accelerated rate by the gears and causing them to spin in alternate directions.

In one aspect, a floor cleaning apparatus comprises a handle having a proximal end and a distal end; a housing at the distal end of the handle; a plurality of wheels at a bottom of the housing that rotate relative to the housing when a force is applied to the handle; a plurality of interchangeable and removable surface-cleaning rollers at the housing that rotate relative to the housing and the wheels, and that rotate at a different rate of rotation than the wheels; and a gear assembly that communicates with the wheels to rotate adjacent surface-cleaning rollers in different directions relative to each other to mimic a scrubbing motion.

In another aspect, a roller assembly for a floor cleaning apparatus comprises a plurality of interchangeable and removable surface-cleaning rollers that rotate to mimic a scrubbing motion; and a gear assembly comprising: a plurality of pulley gears coupled to the rollers; and a belt constructed and arranged to drive the pulley gears in opposite directions to cause the rollers to mimic a scrubbing motion.

In another aspect, a roller assembly for a floor cleaning apparatus comprises a plurality of rollers that rotate to mimic a scrubbing motion; and a gear assembly including: a plurality of pulley gear elements that drive the rollers in different directions to mimic the scrubbing motion, each pulley gear element directly coupled to a roller of the plurality of roller; and a coupling device that removably couples the rollers to the pulley gear elements so that at least one roller can be removed and replaced independently of the other rollers.

BRIEF DESCRIPTION OF THE DRAWINGS

Various aspects of the invention and its embodiment are better understood by referring to the following detailed description. To understand the invention, the detailed description should be read in conjunction with the drawings, in which:

FIG. 4 is a perspective view of a gear assembly of a roller mop, in accordance with some embodiments.

DETAILED DESCRIPTION

Figure 1:
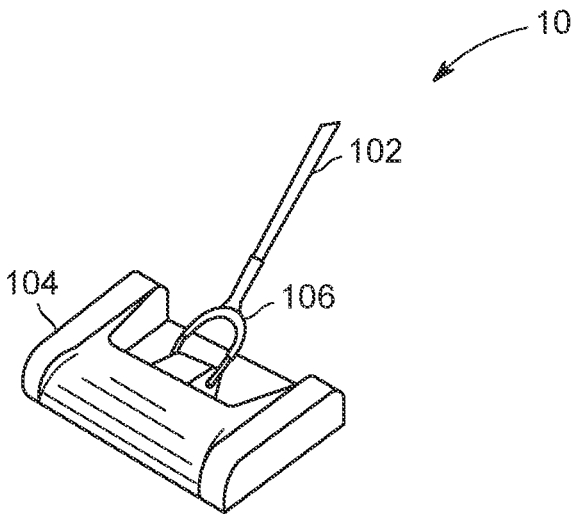
FIG. 1 is a perspective view of a roller mop, in accordance with some embodiments.

Described herein are exemplary embodiments of the best mode of the invention. One should consider the exemplary embodiment as the best mode for practicing the invention during filing of the patent in accordance with the inventor's belief. As a person with ordinary skills in the art may recognize substantially equivalent structures or substantially equivalent acts to achieve the same results in the same manner, or in a dissimilar manner, the exemplary embodiment should not be interpreted as limiting the invention to one embodiment.

The discussion of a species (or a specific item) invokes the genus (the class of items) to which the species belongs as well as related species in this genus. Similarly, the recitation of a genus invokes the species known in the art. Furthermore, as technology develops, numerous additional alternatives to achieve an aspect of the invention may arise. Such advances are incorporated within their respective genus and should be recognized as being functionally equivalent or structurally equivalent to the aspect shown or described.

A function or an act should be interpreted as incorporating all modes of performing the function or act, unless otherwise explicitly stated.

Unless explicitly stated otherwise, conjunctive words (such as "or", "and", "including", or "comprising") should be interpreted in the inclusive and not the exclusive sense.

As will be understood by those of the ordinary skill in the art, various structures and devices are depicted in the block diagram to not obscure the invention. In the following discussion, acts with similar names are performed in similar manners, unless otherwise stated.

The discussions and definitions herein are provided for clarification purposes and are not limiting. Words and phrases are to be accorded their ordinary, plain meaning, unless indicated otherwise.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The manual roller mop assembly may, however, be embodied in many different forms and should not be construed as being limited to the embodiments set forth herein; rather, these embodiments are provided by way of illustration only and so that this disclosure will be thorough, complete and fully convey understanding to those skilled in the art.

It is desirable to have a tool for cleaning floors which does the back-breaking job of scrubbing and wiping away messes. Furthermore, it is desirable to have a mop, broom, or related floor-cleaning apparatus that cleans the floor in less time with less effort. Still, further, it is desirable to have this tool do the work anywhere and anytime, not limited by batteries, electric power and cords. The disclosed device advantageously fills these needs and addresses the aforementioned deficiencies by providing a single device that mimics the work of scrubbing with a sponge, steel wool pad, e.g., Brillo™ pad, or the like by hand, and accelerates the cleaning process and can be used on any hard surface without the need for batteries or electrical power.

Disclosed are embodiments of a manually operated roller mop, which may include but not be limited to the following components: (1) a handle such that a user can comfortably stand and direct the floor housing, (2) a housing consisting of one or more sidewalls, for example, four sides, and a top for enclosing a gear system comprising a plurality of interconnected gears and rollers, (3) wheels for rolling the housing and spinning the gears, (4) the gear system that spins at a higher rate than the wheels (5) surface cleaning roller types that are spun by the gears. The device may also have one or more of the following: (1) a mechanism allowing retraction and extension of the rollers (2) a means for squeezing the sponge rollers while in place; (3) a bottle and trigger mechanism to pre-wet the floor surface; and (4) a receiving compartment for dirty water and debris.

Although a gear system is mentioned herewith, a gear system can include a combination of gears or other components constructed and arranged to transfer rotary motion from one place to another. One type of a gear may include a pulley gear, pinions, or the like which includes a wheel with grooves in its rims, in which a belt or rope can run to transfer rotary motion from one shaft to another. The embodiments herein are not limited thereto. Some gear types may not include a pulley feature, but instead include teeth that interlock, or mesh to form a gear train. Yet other embodiments can include a non-pulley type gear, for example when a belt is not included.

The disclosed device is unique when compared with other known devices and solutions because it saves time mopping or otherwise cleaning a floor by providing a battery and power cord-free solution for cleaning large, light, and heavy soiled surfaces, with less strength and reduces cleanup time.

The disclosed device is unique in that it is structurally different from other known devices or solutions. More specifically, the device is unique due to the presence of a manually powered and operated mop with (1) multiple spinning rollers that mimic the human back and forth action on a soiled spot; and (2) multiple optional roller surfaces to choose from depending on the desired use. Although the term "mop" is used herein, a broom and/or other related floor-cleaning apparatus may equally apply.

FIG. 1 shows an example of how the entire embodiment exterior of a roller map assembly 10 may optionally look in use. In its most complete version, the roller map 10 includes, but is not limited to, (1) a handle 102 such that a user can comfortably stand and direct the floor housing (2) a dense and water-resistant material housing 104 comprising one or more sidewalls and a top enclosure with the bottom open for a plurality of gears and rollers (not shown in FIG. 1) to be exposed and easily accessed (3) four wheels (not shown in FIG. 1) attached to the housing 102 for moving along the floor surface and engaging the gears (4) a gear system (not shown in FIG. 1) that is activated by the wheels at a higher turn ratio than the wheels and (5) one or more rollers (not shown in FIG. 1) that are activated to spin at an accelerated rate by the gears and causing them to spin in alternate directions.

The handle 102 may couple to the housing 104, also referred to as a base, by a pivot assembly or other attachment mechanism 106. The handle 102 has one end holdable by an operator and an opposite end of the handle 102 securable to the housing 104.

In some embodiments, the handle 102 includes an extension that is adjustable, for example, a telescopic arrangement so that the handle length can be increased or decreased to accommodate a user's preference. In some embodiments, as shown in FIG. 1, the attachment mechanism 106 can have a wishbone configuration for rotatably coupling to a protruding region of the top surface of the housing 104, for example, each prong of the attachment mechanism 106 coupled to a bolt or other coupling device extending between the base protrusion and the prong.

The shape, dimensions, or other features of the housing 104 are not limited to that illustrated in FIG. 1. Nevertheless, in addition to coupling to the handle 102, the housing 104 is constructed and arranged to receive a set of wheels and to at least partially enclose a gear assembly, and expose one or more surface-cleaning rollers for directly communicating with a ground surface, e.g., a floor of a building. In some embodiments, the housing 104 includes a compartment, referred to as a receiving compartment for dirt and debris that is captured by the rollers and transferred to the compartment for storage and subsequent removal. In some embodiments, the compartment is a removable enclosure that can be removed from the roller mop for disposing its contents, e.g., dirt and debris collected by the rollers.

Figure 2:
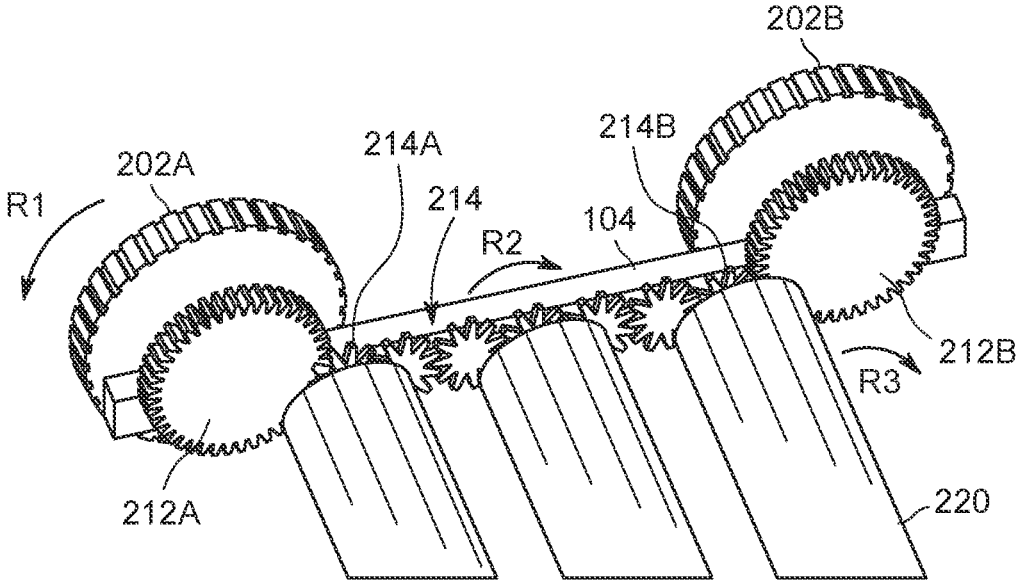
FIG. 2 is a perspective view of a gear assembly of a roller mop, in accordance with some embodiments.

FIG. 2 shows one example of a set of wheels 202 coupled to a bottom region of the housing 104, for example, at four corners about a periphery of the housing 104 that forms the interior of the housing 104. In the embodiment shown in FIG. 2, each wheel 202 is positioned interior to the housing 104 and a first gear 212 is aligned with the corresponding wheel 202 and also positioned at the interior of the housing 104. In other embodiments, the wheels 202 are exterior to the housing. The wheel 202 and first gear 212 may be coupled by a pin, axle, or other elongated object (not shown) that extends through the surface of the housing 104 so that the wheel 202 and first gear 212 can rotate together relative to the housing 104. The first gears 212 engage with a plurality of spur gears 214, referred to as second gears, which in turn are connected to a plurality of removable and interchangeable rollers 220 to effectively cause the rollers 220 to spin at an accelerated rate and predetermined rotational directions when the mop is manually pushed along the surface. In particular, the second gears 214 may form a gear train and are arranged in a linear manner along the interior wall of the housing 104. Each gear 214 is coupled to the housing 104 by a pin or other rotatable object. One first gear 212A and corresponding wheel 202A is positioned on one side of the linear arrangement of second gears 214 to engage with one of the second gears 214A at an end of the arrangement. Another first gear 212B and corresponding wheel 202B is positioned on the other side of the linear arrangement of second gears 214 to engage with one of the second gears 214B at an end of the arrangement. The relative dimensions and features of the first gears 212 and second gears 214, such as diameter, circumference, number of teeth, etc. may establish rate and acceleration of the gears, and in turn the rollers 220. In some embodiments, the second gears 214 may have different dimensions and features. For example, end gears 214A, B engaging with first gears 214 may be larger than second gears 214 between the end gears 214A, B. In other embodiments, the gears 212, 214 may have different dimensions and features so that the rollers 220 may rotate at same or different rates and accelerations relative to each other.

A coupling element or fastening means such as a removable pin extends between each roller 220 and at least one second roller 214 to cause the roller 220 to rotate with the second gears 214. As described herein, the pin may also permit the roller 20 to be interchangeable, namely, removed from the corresponding second gear 214 and replaced with a different roller. As shown in FIG. 2 and as previously mentioned, each of the first gears 212, second gears 214, and rollers 220 rotates at a different rate of rotation (R1, R2, R3, respectively) because of the difference in diameters, circumferences, or related dimensions of the first gears 212, second gears 214, and rollers 220. Details of the rotational relationship between the first gears 212, second gears 214, and rollers 220 are described below.

Figure 3:
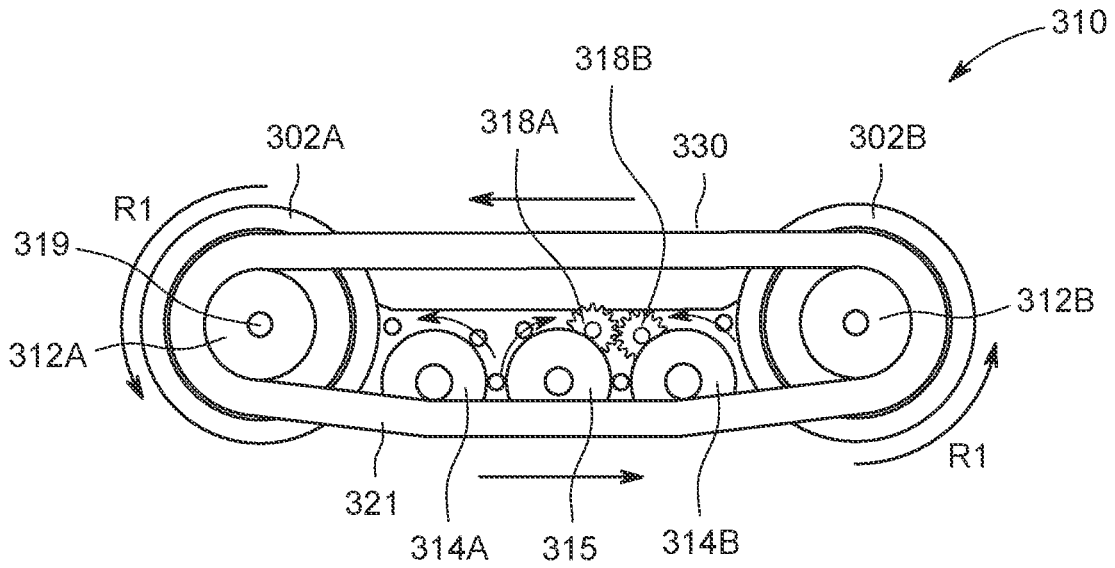

FIG. 3 is a view of a gear assembly 310 of a roller mop, in accordance with some embodiments. The gear assembly 310 can be enclosed in the housing 104 of the roller map 10 of FIG. 1, but not limited thereto. In particular, the gear assembly 310 offers an additional optional method for connecting pulley gears where three of the same size pulley gears 314A, 314B, 314C are caused to move in opposite directions by two smaller pinion gears 318A, 318B. The gear assembly 310 may be powered by one or both wheels 302A, 302B on one side of the housing, but not limited thereto. Although not shown, other embodiments, may include wheels on the opposite side of the housing as wheels 302A, 302B, and likewise be part of the gear assembly 310.

More specifically, the gear assembly 310 includes a set of wheels 302 coupled to a bottom region of a housing (not shown). Each wheel 302 is positioned external to the housing 104 and a first pulley element 312 extends from the corresponding wheel 302 so that they rotate together relative to the housing. In some embodiments, the first pulley elements 312 include a hub and flange construction for accommodating a wheel 302 and belt 330. The first pulley elements 312 may be part of a wheel axis 319. At least one end of the axle 319 can have a first pulley element 312 and corresponding wheel 302 coupled to it. The first pulley elements 312A, 312B are aligned with a plurality of smaller pulley gear elements 314, referred to as second pulley gear elements arranged in a linear manner between two first pulley elements 312A, 312B.

As shown in FIG. 3, in some embodiments, two second pulley gear elements 314A,314B are shown, and a roller element 315 is positioned between the second pulley gear elements 314A, 314B. In some embodiments, the second pulley gear elements 314A,314B include a hub and flange construction for accommodating a rotating belt 330 and a mesh arrangement with neighboring gears such as pinion gears. As shown in FIG. 3, a pulley belt 330 is positioned about the two first pulley elements 312A, 312B and also extends along the second pulley gear elements 314A, 314B, and roller element 315. In some embodiments, the belt 330 includes a first surface 321 and a second surface 322. In some embodiments, the second surface 322, or interior surface, of the belt 330 includes a set of teeth for gripping the various components of the gear assembly 310 during rotation of the wheels 302. In other embodiments, each of the first surface 321 and a second surface 322 have a set of teeth.

In some embodiments, the second pulley gear elements 314 each includes a gear 316 and the roller element 315 includes a gear 317, which form a gear mesh arrangement such as a gear train with the smaller pinion gears 318A, 318B.

FIG. 3 also illustrates the rotational directions of the second pulley gear elements 314A, 314B, roller element 315, and pinion gears 318A, 318B when the belt 330 rotates in a counter-clockwise direction. During operation, the motion of the wheels 304A, 302B rotate in the same direction as the belt 330 due to the first pulley elements 312A, 312B rotating in response to a force being applied to the wheels 304, for example, by a user applying a force to the mop handle 102. Although not shown in FIG. 3, a removable roller similar to or the same as a roller 220 in FIG. 2 can be attached to each of the second pulley gear elements 314A, 314B and the roller element 315. The belt 330 during rotation causes the second pulley gear elements 314A, 314B and the roller element 315, which in turn cause the rollers to rotate in opposing directions relative to each other. For example, a roller coupled to pulley gear element 314B rotates in a counter-clockwise direction and at the same time a roller coupled to roller element 315 rotates in a clockwise direction due to the mesh arrangement of the two pinion gears 318A, 318B, also referred to as reverse gears. In some embodiments, the reverse gears 318 are smaller than the primary gears 314. In other embodiments, the gears 314, 318 are the same size. The reverse gears 318A, 318B can cause a middle pulley gear 315 to rotate in an opposite direction than pulley gears 314A, 314B on either side of the middle pulley gear 315.

In addition to the direction of rotation of the rollers, gears, etc., the gear assembly 310 is constructed and arranged to cause the rollers to rotate at an accelerated rate and at different rates of rotation relative to the wheels 302 when the mop is manually pushed along the surface. In particular, the wheels 302 are connected to a pulley system formed by the belt 330 and pulley elements 312 and pulley gears 314 that turns a set of smaller circumference pulley gears 318 at a rate faster than the rate of the wheels 302 when the roller mop 10 is manually pushed.

Figure 4:
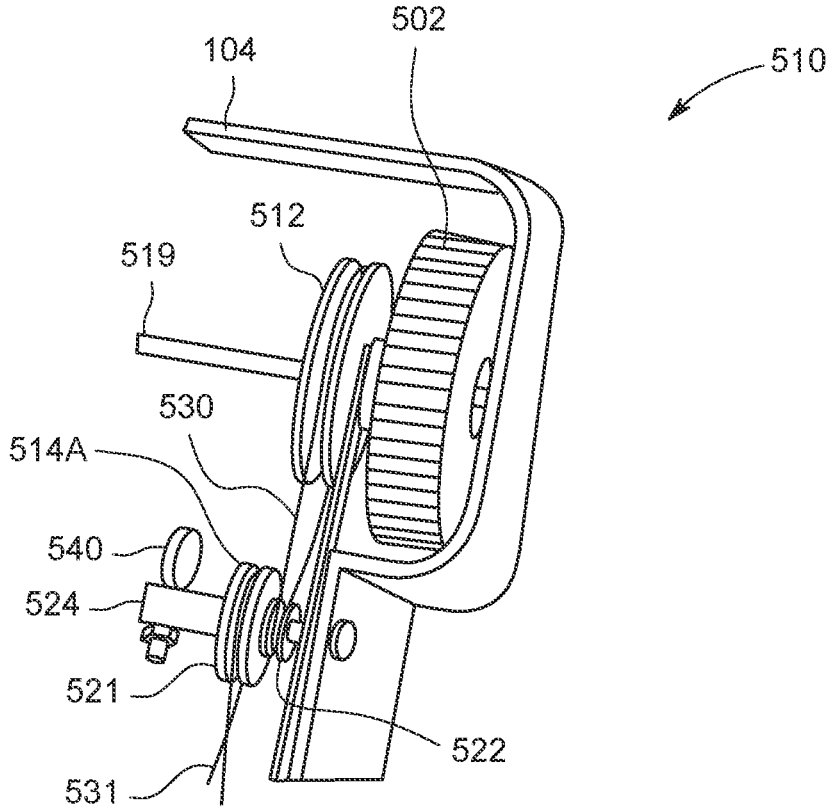
FIG. 4 is a side view of the gear assembly of a roller mop, in accordance with some embodiments.

FIG. 4 is a perspective view of a gear assembly 510 of a roller mop 10 including another optional method for connecting pulley gear elements 512, 514, e.g., pulley gears, to a wheel 502, in accordance with some embodiments. A first pulley gear element 512 is coupled to an axle 519, which in turn is coupled to a wheel 502. In some embodiments, only one of four wheels 502 includes the first pulley gear element 512 for driving the gear assembly 510, but is not limited thereto. Other embodiments may include multiple wheels 502 may include the first pulley gear element 512. A first belt 530, or cord, cable, chain, rope, or the like, is positioned about the first pulley gear element 512. When the wheel 502 rotates, the axle 519 and first pulley gear element 512 rotate, causing the first belt 530 to likewise rotate. The first belt 530 extends from the first pulley gear element 512 to a flange 522 of a second pulley gear element 514. A second belt 531, or cord, cable, chain, rope, or the like is positioned about a hub pulley 521 portion of the second pulley gear element 514. The rotation of the first belt 530 results in a corresponding rotation of the second belt 531, which is positioned about a second pulley gear element 514A. In some embodiments, the second pulley gear element 514A includes a coupling mechanism 524 attached to and extending from the second pulley gear element 514A, and that rotates with the second pulley gear element 514A. The second pulley gear element 514A has a different diameter than the first pulley gear element 512. Therefore, the coupling mechanism 524 rotates at a different rotation rate than the wheel axle 519 coupled to the first pulley gear element 512.

Figure 5:
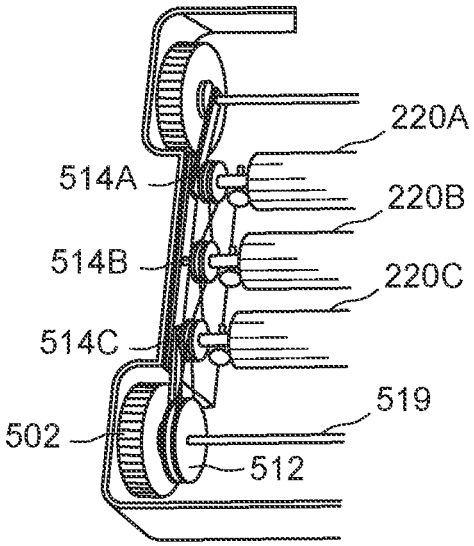
FIG. 5 is a bottom perspective view of a gear assembly of a roller mop, in accordance with some embodiments.

FIG. 4 illustrates the arrangement of the second belt 531 about a plurality of second pulley gear elements 514, which includes the second pulley gear element 514A in FIG. 5. The second belt 531 is wound so that a neighboring second pulley gear element 514 rotates in an opposite direction.

More specifically, FIG. 5 is a bottom view of an embodiment of the gear assembly 510 of FIG. 4, where the first pulley gear element 512 is attached to a set of gears of a plurality of second pulley gear elements 514 and connected to rollers 220 in a manner that allows them to spin in opposite directions.

As previously described, first belt 530 extends between the first pulley gear element 512 and an initial second pulley gear element 514A. The second belt 531 is arranged between the initial second pulley gear element 514A and the other second pulley gear elements 514B and 514C. Although three second pulley gear elements 514A-514C (generally, 514) are illustrated, other embodiments can include more than three second pulley gear elements 514. Referring to FIGS. 4-5, the second belt 531 is weaved between the second pulley gear elements 514A-514C. For example, a portion of the second belt 531 extends from a top surface of a second pulley gear element 514A to a bottom surface of adjacent second pulley gear element 514B, then further extends to a top surface of adjacent second pulley gear element 514C. The second belt 531 then wraps around the second pulley gear element 514C to extend from the top to the bottom surface of second pulley gear element 514 then to a top surface of second pulley gear element 514B, then to a bottom surface of second pulley gear element 514B. Accordingly, in response to a rotation of the first belt 530, the weaving arrangement of the second belt 531 about the second pulley gear elements 514A-514C causes second pulley gear elements 514A and 514C to rotate in an opposite direction than second pulley gear element 514B. Accordingly, rollers 220A and 220C coupled to extensions 524 of second pulley gear elements 514A and 514C, respectively, rotate in opposite directions than roller 220B.

In some embodiments the second belt 531 has a set of teeth on both sides of the belt 531 in order to grip the top or bottom of any of the second pulley gear elements 514 during movement of the second belt 531 about each of the second pulley gear elements 514. The hub pulley 521 portion of the second pulley gear elements 514 can include gear teeth for mating with the teeth of the second belt 531 and to provide an improved grip for applying a force by the gear assembly 510 on the rollers 220 when the wheels 502 rotate.

Figure 6:
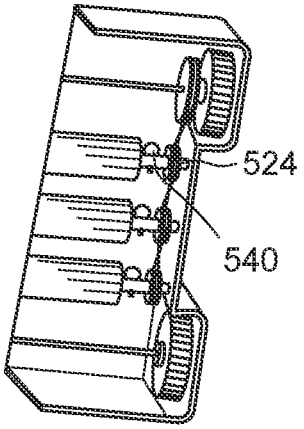
FIG. 6 is a perspective view of a removable roller assembly of a roller mop, in accordance with other embodiments.

Referring to FIG. 6, the roller map 10 in some embodiments includes a removable roller assembly comprising a pin 540, e.g., similar to a cotter pin or the like, or other coupling device for removably coupling a roller 220 to a second pulley gear element 514, more specifically, the coupling mechanism 524 extending from the second pulley gear element 514A. Although a pin 540 is referred to as an example of a coupling mechanism, it is not limited thereto. For example, a coupling mechanism may include a spring 611 (see FIGS. 11, 12A and 12B), push-button, and/or other mechanical components that hold a roller 220 in place to rotate with the second pulley gear element 514. In some embodiments, as shown in FIGS. 10-12B the coupling mechanism, such as a pin 540, includes a release means that includes a spring that expands due to the spring force to separate the roller 220 from the corresponding pulley gear element.

The pin 540 when removed allows a roller 220 to be removed and replaced with a new roller. After the new roller 220 is inserted the pin 540 is inserted into the coupling mechanism 524 to hold the new roller 220 in place against the second pulley gear element 514 and rotate with the second pulley gear element 514 during operation. Different roller types can be inserted and removed depending on need, application, feature, or any other reasons. During operation, all inserted rollers 220 may be the same or different. For example, referring again to FIG. 6, one roller 220A may be replaced by a different roller that is different than the other rollers 220B, 220C. For example, other rollers 220B, 220C may have a cloth surface for removing loose debris from a floor surface, while roller 220B has a course surface for removing stains or other difficult-to-remove particles from the floor surface. In some embodiments, the rollers are sponge rollers. Here, the roller mop 10 includes a means for engaging and squeezing the sponge rollers.

Figure 7:
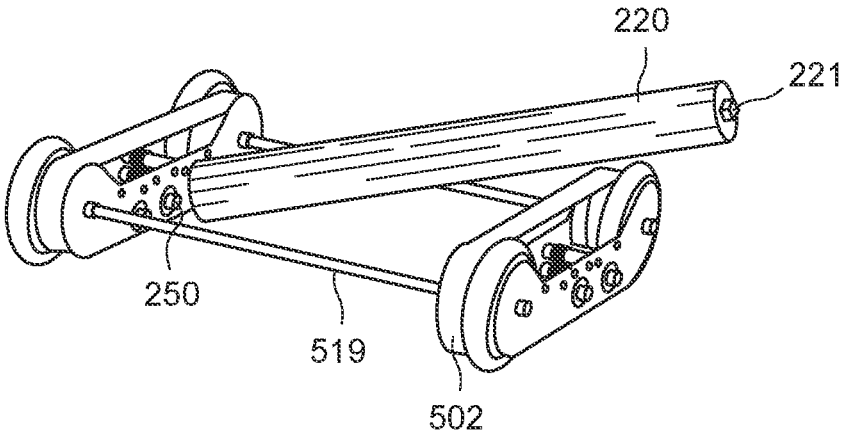
FIG. 7 is a perspective view illustrating a technique for removing a roller from a roller mop, in accordance with some embodiments.
Figure 8:
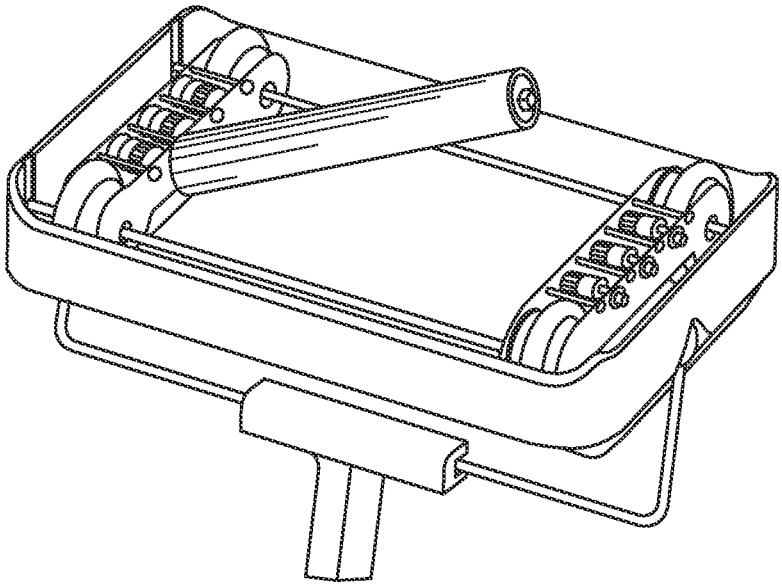
FIG. 8 is another perspective view illustrating a technique for removing a roller from a roller mop, in accordance with some embodiments.

FIG. 7 is a perspective view illustrating a technique for removing a roller 220 from a roller mop 10, in accordance with some embodiments. The roller mop 10 may include the gear assembly 310 shown and described with reference to FIGS. 2-3 or the gear assembly 510 shown and described with reference to FIGS. 4-6.

Figure 9A:
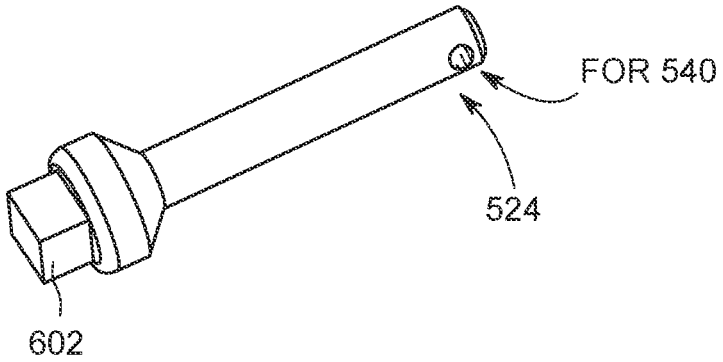
FIG. 9A is a perspective view of a coupling element of FIGS. 5-7.
Figure 9B:
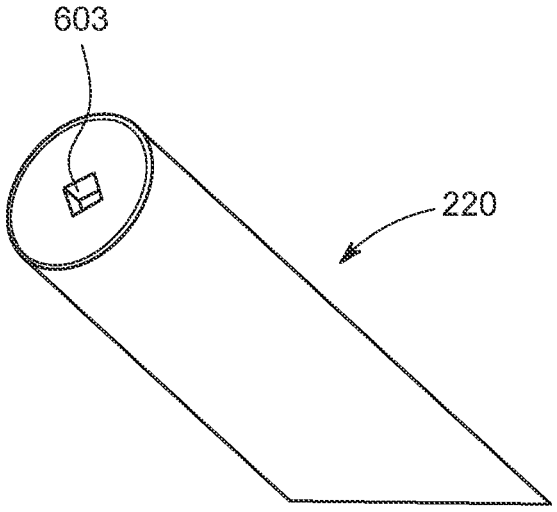
FIG. 9B is a perspective view of an end of a roller, in accordance with some embodiments.
Figure 10:
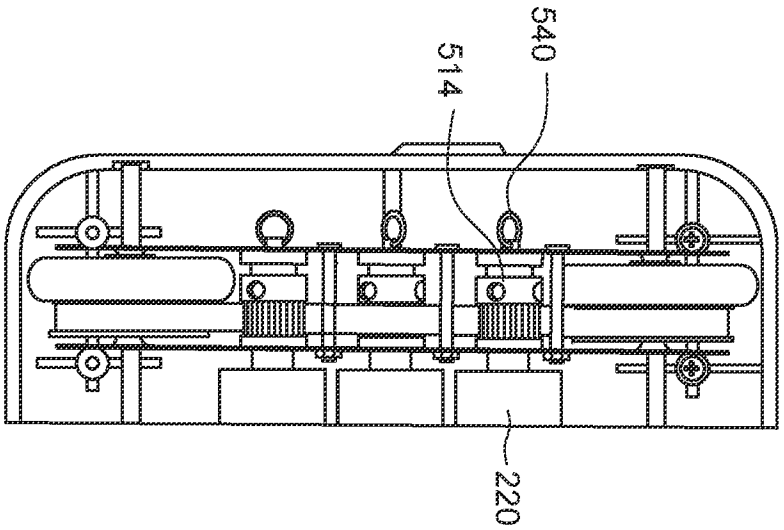
FIG. 10 is a cutaway view of a of a gear assembly of a roller mop, in accordance with some embodiments.
Figure 11:
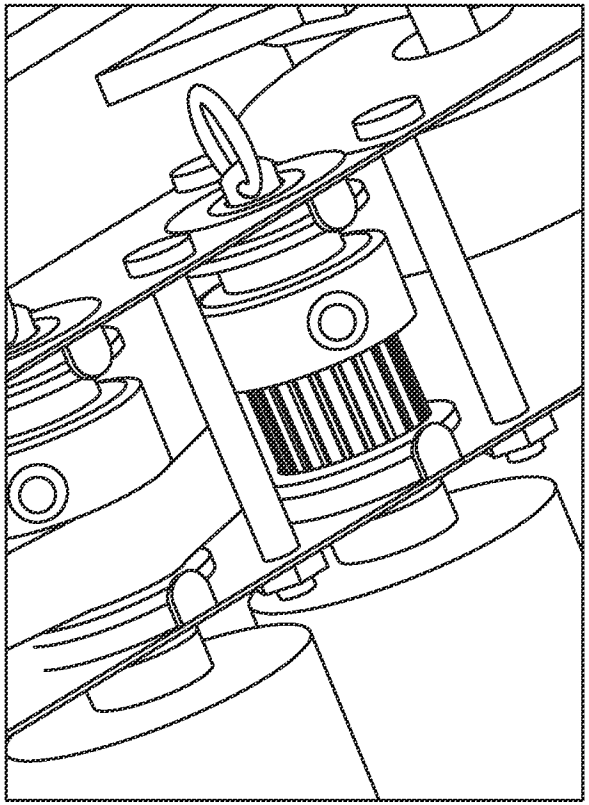
FIG. 11 is a closeup perspective view of a coupling mechanism coupled to an end of a roller in a roller mop, in accordance with some embodiments.
Figure 12A:
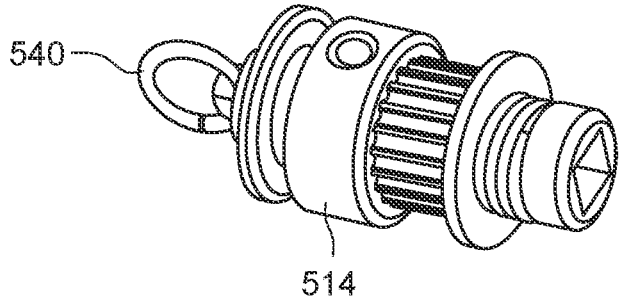
FIGS. 12A and 12B are perspective views of a pulley gear element coupling mechanism in compressed and uncompressed states, respectively, in accordance with some embodiments.
Figure 12B:
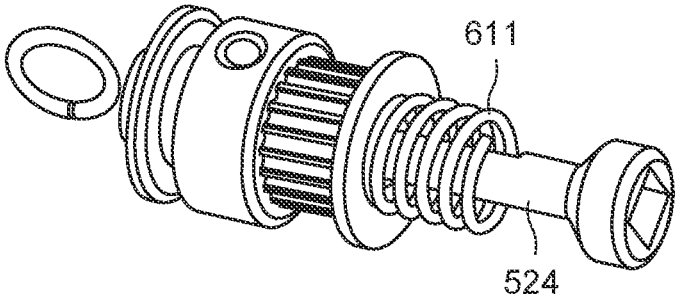

As shown in FIG. 7, the roller 220 may have a pin 221 or related protrusion that extends from at least one end of the roller 220. In other embodiments, as shown in FIG. 9B, the end of the roller 220 may have a square, rectangular, or other polygon shaped female connector 603 for receiving an end 602 of the connector 524. Other components such as springs or the like may be included that are attached to the gears and rollers for releasing them. In some embodiments, the pulley gears 314 (FIG. 2-3) or 514 (FIGS. 4-7) may include recesses for mating with the roller pins 221 and allowing the roller 220 to rotate with the pulley gears 314, 514. During insertion of a roller 220, a protrusion 221 at one end of the roller 220 is inserted into a recess 250, then the protrusion 221 at the other end of the roller 220 is inserted into a recess of a pulley gear at the opposite end of the assembly. In some embodiments, the protrusion 221 is square, rectangular, or the like to mate with the recess 250 to reduce the risk of slippage or problems with rotating the rollers 220 during operation. In other embodiments, the roller pins 221 are inserted into a coupling mechanism 524 (see FIGS. 4-7) and locked in place in the pulley gears 514 by a pin 540 or the like, also shown in FIGS. 10 and 11.

As shown, the apparatus can be configured for a "pull pin" on the outside of the plate to release the rollers. However, other embodiments may include the use of a push mechanism instead of a pull pin to release the rollers for ease of use.

Although the invention has been described and illustrated with specific illustrative embodiments, it is not intended that the invention be limited to those illustrative embodiments. Those skilled in the art will recognize that variations and modifications can be made without departing from the spirit of the invention. Therefore, it is intended to include within the invention, all such variations and departures that fall within the scope of the appended claims and equivalents thereof.

As will be appreciated by one skilled in the art, aspects of the present invention may be embodied as a system, method, and apparatus. Thus, some aspects of the present invention may be embodied entirely in hardware, entirely in software (including, but not limited to, firmware, program code, resident software, microcode), or in a combination of hardware and software.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Embodiments of the methods and apparatuses discussed herein are not limited in application to the details of construction and the arrangement of components set forth in the foregoing description or illustrated in the accompanying drawings. The methods and apparatuses are capable of implementation in other embodiments and of being practiced or of being carried out in various ways. Examples of specific implementations are provided herein for illustrative purposes only and are not intended to be limiting. References to "one embodiment" or "an embodiment" or "another embodiment" means that a feature, structure or characteristic described in connection with the embodiment is included in at least one embodiment described herein. References to one embodiment within the specification do not necessarily all refer to the same embodiment. The features illustrated or described in connection with one exemplary embodiment may be combined with the features of other embodiments.

Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all the described terms. Any references to front and back, left and right, top and bottom, upper and lower, and vertical and horizontal, and the like are intended for convenience of description, not to limit the present systems and methods or their components to any one positional or spatial orientation. Accordingly, the foregoing description and drawings are by way of example only, and the scope of the invention should be determined from proper construction of the appended claims, and their equivalents.

What is claimed is:

1. A floor cleaning apparatus, comprising: a handle having a proximal end and a distal end;

a housing at the distal end of the handle;

a plurality of wheels at a bottom of the housing that rotate relative to the housing when a force is applied to the handle;

a plurality of interchangeable and removable surface-cleaning rollers that include at least two outer rollers and one middle roller, which rotate relative to the housing and the wheels, and that rotate at a different rate of rotation than the wheels; and a gear and pulley assembly that communicates with the wheels to rotate adjacent surface-cleaning rollers in different directions relative to each other to mimic a scrubbing motion, the gear and pulley assembly comprising:

first pulley elements wherein each pulley element is coupled to one of the plurality of wheels;

each of the first pulley elements are linearly arranged for movement with a plurality of smaller second pulley gears forming a gear train, the second pulley gears are arranged so that:

two of the second pulley gears have a first one of the outer rollers positioned between them, two of the second pulley gears have the middle roller positioned between them, and two of the second pulley gears have a second one of the outer rollers positioned between them;

a pulley belt positioned about the first pulley elements, second pulley gears, and the rollers;

the pulley belt includes teeth on both an outer surface and an inner surface for gripping components of the gear and pulley assembly.

2. The floor cleaning apparatus of claim 1, further comprising a coupling mechanism for removably coupling each of the rollers to the gear and pulley assembly, wherein each coupling mechanism is a push-button.

3. The floor cleaning apparatus of claim 1, further comprising a mechanism for inserting or removing the rollers, the mechanism comprising a protrusion or a female connector at the ends of the rollers.

4. The floor cleaning apparatus of claim 1, wherein the rollers are independently replaceable to provide one or more rollers of different type for cleaning different types of dirt and different floor surfaces.

* * * * *